US011408669B2

(12) United States Patent
Yang et al.

(10) Patent No.: US 11,408,669 B2
(45) Date of Patent: Aug. 9, 2022

(54) REFRIGERATOR

(71) Applicant: HAIER SMART HOME CO., LTD., Shandong (CN)

(72) Inventors: Falin Yang, Qingdao (CN); Jian Zhang, Qingdao (CN); Dong Wei, Qingdao (CN); Guangrui Wu, Qingdao (CN); Zhongling Yang, Qingdao (CN)

(73) Assignee: HAIER SMART HOME CO., LTD., Qingdao (CN)

( * ) Notice: Subject to any disclaimer, the term of this patent is extended or adjusted under 35 U.S.C. 154(b) by 0 days.

(21) Appl. No.: 17/273,229

(22) PCT Filed: Aug. 22, 2019

(86) PCT No.: PCT/CN2019/101943
§ 371 (c)(1),
(2) Date: Mar. 3, 2021

(87) PCT Pub. No.: WO2020/048320
PCT Pub. Date: Mar. 12, 2020

(65) Prior Publication Data

US 2021/0190415 A1 Jun. 24, 2021

(30) Foreign Application Priority Data

Sep. 3, 2018 (CN) ..... 201821433767.3

(51) Int. Cl.
*F25D 23/02* (2006.01)
*F25D 25/02* (2006.01)
(Continued)

(52) U.S. Cl.
CPC ..... *F25D 25/025* (2013.01); *F25D 11/02* (2013.01); *F25D 29/005* (2013.01); *F25D 2400/40* (2013.01)

(58) Field of Classification Search
CPC ..... F25D 25/025; F25D 11/02; F25D 29/005; F25D 2400/40
See application file for complete search history.

(56) References Cited

U.S. PATENT DOCUMENTS 9,046,295 B2 * 6/2015 Han ..... F25D 25/025
9,115,929 B2 * 8/2015 Han ..... F25D 23/02
(Continued)

FOREIGN PATENT DOCUMENTS

CN 108426415 A 8/2018
CN 209054845 U 7/2019
(Continued)

OTHER PUBLICATIONS

International Search Report for International Application No. PCT/CN2019/101943, dated Nov. 19, 2019.
(Continued)

*Primary Examiner* — Kimberley S Wright
(74) *Attorney, Agent, or Firm* — Alston & Bird LLP

(57) ABSTRACT

A refrigerator comprises: a storage compartment; a push-pull drawer provided in the storage compartment; and a slide rail assembly provided between the drawer and a sidewall of the storage compartment. The slide rail assembly comprises a first supporting member extending in a push-pull direction of the drawer and connected to one sidewall of the storage compartment. A front end of the first supporting member is provided with an installation portion. A terminal box cover is fixed to a top portion of the installation portion. A bottom portion of the installation portion is provided with an installation portion fixing structure. The installation portion fixing structure comprises multiple jaws for fixing cable assemblies extending out of the terminal box cover. The multiple jaws are arranged at intervals along a curved line.
(Continued)

The curved line has a convex apex at a middle portion thereof and slopes downwards toward two ends thereof.

9 Claims, 3 Drawing Sheets

(51) Int. Cl.
*F25D 11/02* (2006.01)
*F25D 29/00* (2006.01)

(56) References Cited

U.S. PATENT DOCUMENTS 9,523,531 B2 * 12/2016 Han ..... F25D 23/028
9,585,474 B2 * 3/2017 Haltmeyer ..... F25D 23/067
9,951,988 B2 * 4/2018 Han ..... F25D 11/00
10,823,486 B2 * 11/2020 Han ..... F25D 25/025
2003/0173882 A1 * 9/2003 Koons ..... F25D 25/025 312/404
2004/0035129 A1 * 2/2004 Kaiser ..... A47B 88/40 62/302
2006/0056165 A1 * 3/2006 Tsunoda ..... H02G 11/00 361/826
2011/0005264 A1 * 1/2011 Lee ..... F25D 25/025 62/449
2011/0181163 A1 * 7/2011 Han ..... F25D 11/00 312/405
2015/0022072 A1 * 1/2015 Haltmeyer ..... A47B 97/00 312/401
2015/0069899 A1 * 3/2015 Han ..... F25D 23/02 312/404
2017/0160000 A1 * 6/2017 Haltmeyer ..... F25D 23/067
2018/0224200 A1 * 8/2018 Haltmeyer ..... A47B 88/49

FOREIGN PATENT DOCUMENTS

CN 209054846 U 7/2019
JP 2008143325 A 6/2008

OTHER PUBLICATIONS

Written Opinion of the International Searching Authority for International Application No. PCT/CN2019/101943, dated Nov. 19, 2019.
Extended European Search Report for EP Application 19858532.5 dated Oct. 11, 2021 (4 pages).
First Office Action for EP Application No. 19858532.5 dated Oct. 22, 2021 (6 pages).
1st Examination Report for Australian Application No. 2019335262 dated Feb. 4, 2022 (3 pages).
2nd Office Action for EP Application No. 19858532.5 dated Mar. 28, 2022 (4 pages).

* cited by examiner

REFRIGERATOR

CROSS-REFERENCE TO RELATED APPLICATIONS

The present application is a national phase entry of International Application No. PCT/CN2019/101943, filed Aug. 22, 2019, which claims priority to Chinese Patent Application No. 201821433767.3, filed Sep. 3, 2018, respectively, which are incorporated herein by reference in their entirety.

FIELD OF THE INVENTION

The present invention relates to the field of household appliances, and particularly relates to a refrigerator.

BACKGROUND OF THE INVENTION

Drawers of some high-end refrigerators are provided with electrical components, such as a temperature control panel on a front end plate of a temperature-variable drawer of a high-end French refrigerator. A wire harness and a terminal component which are connected to an electrical component need to be buried in a slide rail of the drawer and connected to a box body of the refrigerator, so as to realize power transmission.

In the prior art, a through hole is generally provided for threading a wire harness. However, such a through hole usually has a relatively single function and is only used for the wire harness to pass through.

BRIEF DESCRIPTION OF THE INVENTION

An objective of the present invention is to provide a refrigerator having a fixing structure with a wire harness guiding function.

Specifically, the present invention provides a refrigerator, including:

a storage compartment;

a drawer, arranged in the storage compartment in a drawable manner; and a slide rail assembly, arranged between the drawer and a side wall of the storage compartment and comprising:

a first support member, extending along a pulling direction of the drawer and connected to a side wall of the storage compartment, a front end of the first support member provided with an installation part, wherein a top of the installation part is fixedly provided with a terminal box cover; a bottom of the installation part is provided with an installation part fixing structure; the installation part fixing structure includes a plurality of claws configured to fix a wire harness threaded from the terminal box cover; the plurality of claws are arranged at intervals along an arc; and the arc is in a form that a middle part bulges upward and both ends hang downward.

Optionally, there are three claws respectively arranged at the middle part and both ends of the arc.

Optionally, each of the plurality of claws includes:

an arched tube, a side of the tube and the installation part forming an inlet of the wire harness; and a baffle plate, erected on the side of the tube provided with the inlet of the wire harness and forming an access passage of the wire harness together with the tube, so that the wire harness enters inside the tube sequentially from the access passage of the wire harness and the inlet of the wire harness so as to fix the wire harness.

Optionally, the bottom of the installation part is in a box shape and includes a bottom wall and side walls surrounding the bottom wall; the bottom wall and the side walls define an accommodating cavity with an opening facing the side wall of the storage compartment; and the plurality of claws are located in the accommodating cavity.

Optionally, the side wall at the bottom of the installation part is provided with a notch for the wire harness threaded from the installation part fixing structure to pass through.

Optionally, the refrigerator further includes:

a second support member, extending along the pulling direction of the drawer and connected to the drawer; and a wiring box, extending along the pulling direction of the drawer, and the wiring box together with the second support member defining a cavity which extends along the pulling direction of the drawer, and is used for threading the wire harness threaded from the installation part.

Optionally, the second support member includes a vertical plate part vertically arranged and a flat plate part protruding from the vertical plate part toward the first support member; and the wiring box includes a first side surface arranged in parallel with the flat plate part, and a second side surface and a third side surface arranged at two ends of the first side surface and perpendicular to the first side surface, wherein the second side surface is attached to the vertical plate part, and the first side surface, the second side surface, the third side surface and the flat plate part define the cavity.

Optionally, a rear end and a front end of the cavity are respectively provided with a first opening and a second opening, so that the wire harness threaded from the terminal box cover is threaded into the cavity from the first opening, then is threaded out through the second opening, and is connected to an electrical component at a front end of the drawer.

Optionally, the cavity is internally provided with a plurality of cavity fixing structures arranged at intervals along the pulling direction of the drawer and used for threading and fixing the wire harness.

Optionally, the drawer is a drawable temperature-variable drawer.

In the present invention, the claws are arranged to be distributed along the above arc so that the wire harness forms a downward threading trend to ensure the direction of the wire harness. Furthermore, the claws may lock the wire harness, so that the wire harness is not easy to fall off and loosen when moving with the drawer. After actual tests on a model machine, the threading manner of the present invention enables the wire harness to pass the test of a large number of pulling times in a low-temperature storage environment.

Further, in the present invention, the installation part is arranged in a box shape with an accommodating cavity so as to provide an accommodating space for the wire harness and the installation part fixing structure, so that the wire harness can be embedded in the installation part and is not easy to rub against other components, thereby protecting the wire harness.

According to the following detailed descriptions of specific embodiments of the present invention in conjunction with the drawings, those skilled in the art will more clearly understand the above and other objectives, advantages and features of the present invention.

BRIEF DESCRIPTION OF THE DRAWINGS

Some specific embodiments of the present invention are described in detail below with reference to the drawings by way of example and not limitation. The same reference numerals in the drawings indicate the same or similar components or parts. Those skilled in the art should understand that these drawings are not necessarily drawn in scale. In the drawings.

DETAILED DESCRIPTION

Figure 1:
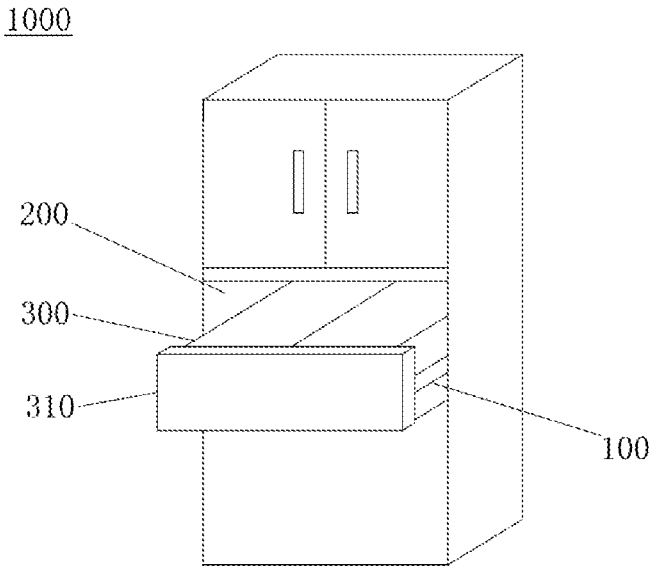
FIG. 1 is a schematic structural diagram of a refrigerator according to an embodiment of the present invention.

FIG. 1 is a schematic structural diagram of a refrigerator according to an embodiment of the present invention. As shown in FIG. 1, the present embodiment provides a refrigerator 1000, including a storage compartment 200, a drawer 300 and a slide rail assembly 100. The drawer 300 is arranged in the storage compartment 200 in a drawable manner, which generally refers to the drawer 300 whose front end plate 310 is directly used as a sealing door of the storage compartment 200, such as a drawable temperature-variable drawer. Inside the front end plate 310 of the drawer 300, electrical components may be arranged, such as a control panel, a display device and so on. These electrical components need to be connected to the electrical components of the box body of the refrigerator 1000 through wire harnesses. However, since the position of the front end plate 310 of the drawer 300 moves relative to the box body during the pulling process, this brings difficulties to the arrangement of the wire harnesses.

Figure 2:
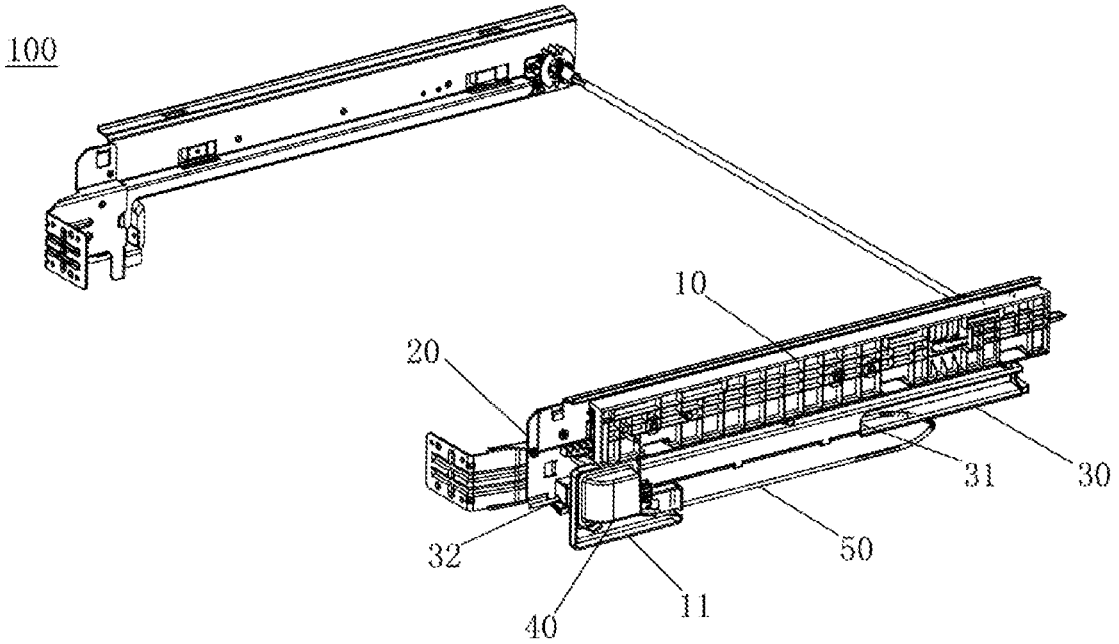
FIG. 2 is a schematic structural diagram of a slide rail assembly in a refrigerator according to an embodiment of the present invention.
Figure 3:
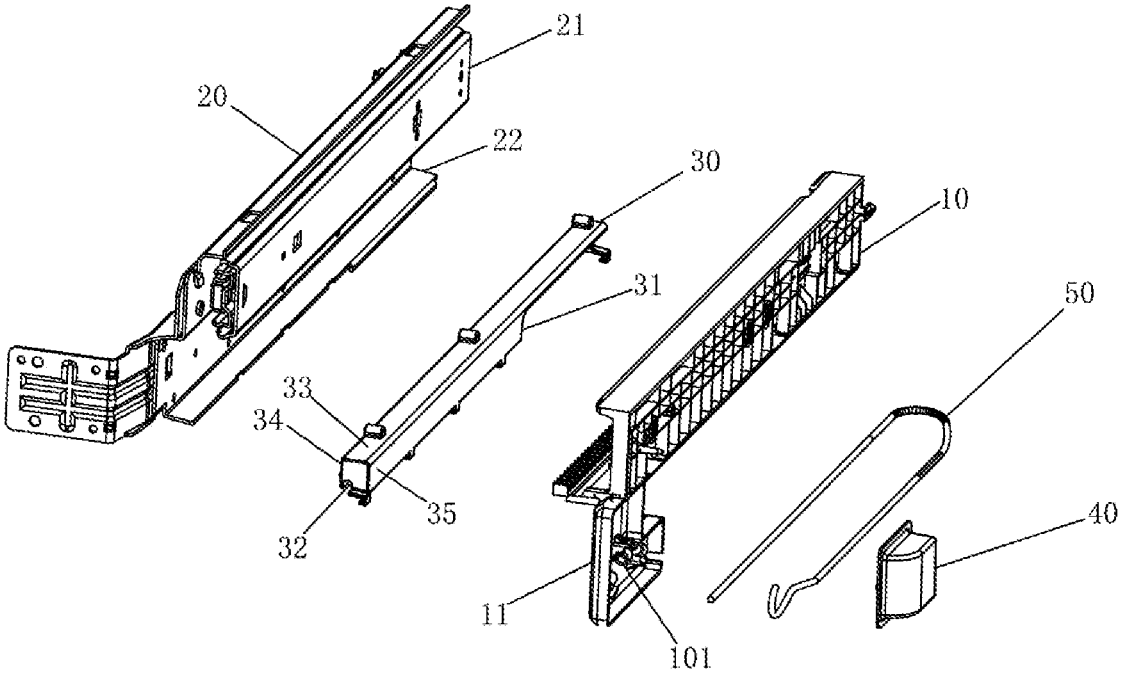
FIG. 3 is a schematic exploded diagram of a slide rail assembly in a refrigerator according to an embodiment of the present invention.

FIG. 2 is a schematic structural diagram of a slide rail assembly in a refrigerator according to an embodiment of the present invention. FIG. 3 is a schematic exploded diagram of a slide rail assembly in a refrigerator according to an embodiment of the present invention. As shown in FIG. 1, the slide rail assembly 100 is arranged between the drawer 300 and the side wall of the storage compartment 200 and includes a first support member 10 (referring to FIG. 2). The first support member 10 extends along the pulling direction of the drawer 300 and is connected to a side wall of the storage compartment 200, and the front end of the first support member 10 is provided with an installation part 11. The top of the installation part 11 is fixedly provided with a terminal box cover 40, and the terminal box cover 40 is connected to an electrical component through a wire harness 50. As shown in FIG. 3, the bottom of the installation part 11 is provided with an installation part fixing structure 101; the installation part fixing structure 101 includes a plurality of claws configured to fix the wire harness 50 threaded from the terminal box cover 40; the plurality of claws are arranged at intervals along an arc; and the arc is in a form that the middle part bulges upward and both ends hang downward.

In the present embodiment, the claws are arranged to be distributed along the above arc so that the wire harness 50 forms a downward threading trend to ensure the direction of the wire harness 50. Furthermore, the above claws may lock the wire harness 50, so that the wire harness 50 is not easy to fall off and loosen when moving with the drawer 300.

Optionally, there are three claws respectively arranged at the middle part and both ends of the arc.

Figure 4:
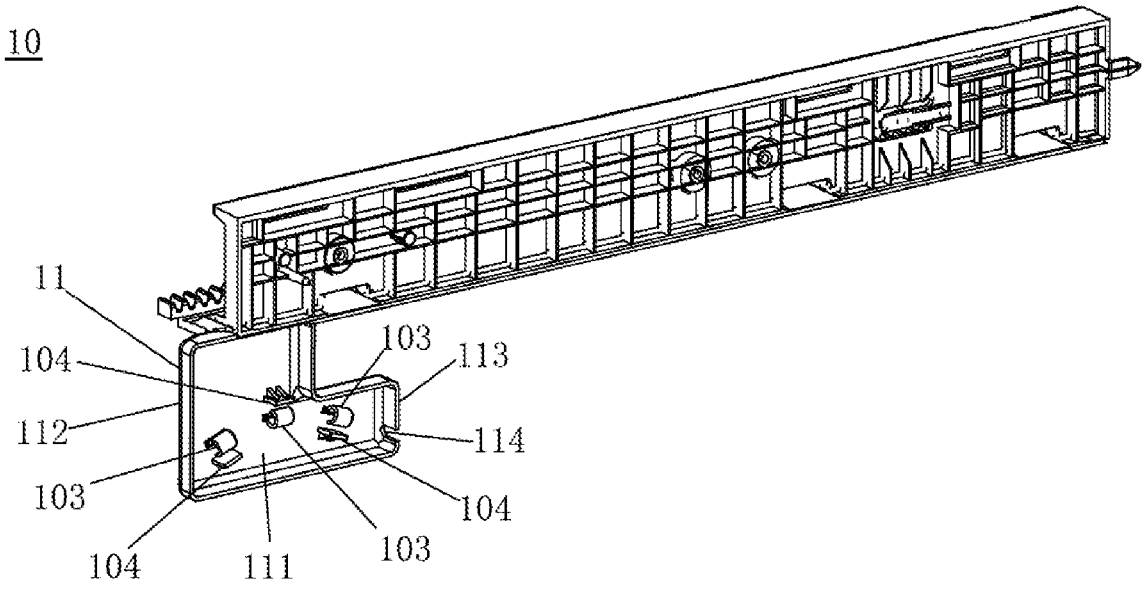
FIG. 4 is a schematic structural diagram of a first support member of a slide rail assembly in a refrigerator according to an embodiment of the present invention.

FIG. 4 is a schematic structural diagram of a first support member of a slide rail assembly in a refrigerator according to an embodiment of the present invention. As shown in FIG. 4, in an embodiment, each of the plurality of claws includes an arched tube 103 and a baffle plate 104. A side of the tube 103 and the installation part 11 form an inlet of the wire harness 50. The baffle plate 104 is erected on the side of the tube 103 provided with the inlet of the wire harness 50 and forms an access passage of the wire harness 50 together with the tube 103, so that the wire harness 50 enters inside the tube 103 sequentially from the access passage of the wire harness 50 and the inlet of the wire harness 50 so as to fix the wire harness 50.

In another embodiment, as shown in FIG. 4, the bottom of the installation part 11 is in a box shape and includes a bottom wall 112 and side walls 113 surrounding the bottom wall 112; the bottom wall 112 and the side walls 113 define an accommodating cavity 111 with an opening facing the side wall 113 of the storage compartment 200; and the plurality of claws are located in the accommodating cavity 111. The installation part 11 is arranged in a box shape with the accommodating cavity 111 so as to provide an accommodating space for the wire harness 50 and the installation part fixing structure 101, so that the wire harness 50 can be embedded in the installation part 11 and is not easy to rub against other components, thereby protecting the wire harness 50.

In an embodiment, as shown in FIG. 4, the side wall 113 at the bottom of the installation part 11 is provided with a notch 114 for the wire harness 50 threaded from the installation part fixing structure 101 to pass through.

As shown in FIG. 3, in another embodiment, the refrigerator 1000 further includes a second support member 20 and a wiring box 30. The second support member 20 extends along the pulling direction of the drawer 300 and is connected to the drawer 300. The wiring box 30 extends along the pulling direction of the drawer 300, and the wiring box 30 and the second support member 20 define a cavity which extends along the pulling direction of the drawer 300 and is used for threading the wire harness 50 threaded from the installation part 11.

Figure 5:
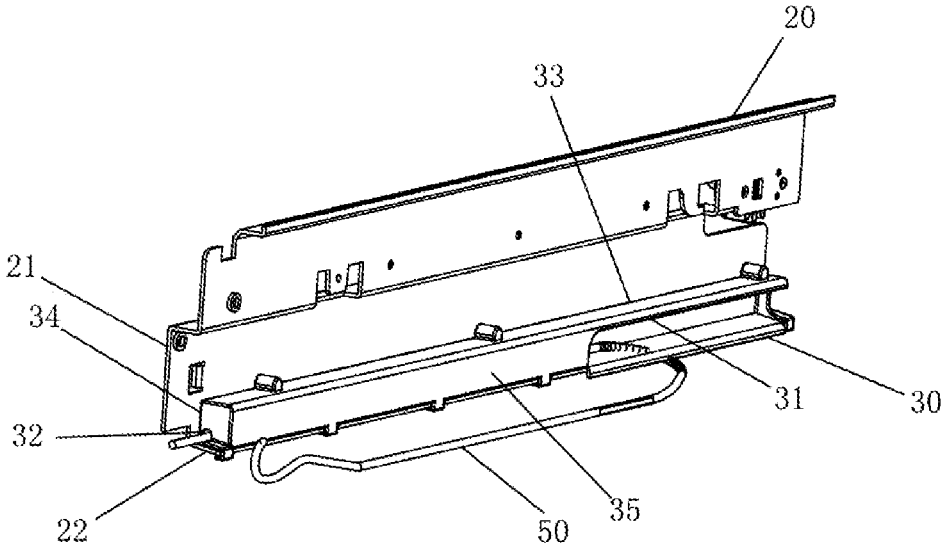
FIG. 5 is a schematic assembly diagram of a second support member, a wiring box and a wire harness of a slide rail assembly in a refrigerator according to an embodiment of the present invention.

FIG. 5 is a schematic assembly diagram of a second support member, a wiring box and a wire harness of a slide rail assembly in a refrigerator according to an embodiment of the present invention. Optionally, as shown in FIG. 5, the second support member 20 includes a vertical plate part 21 vertically arranged and a flat plate part 22 protruding from the vertical plate part 21 toward the first support member 10. The wiring box 30 includes a first side surface 33 arranged in parallel with the flat plate part 22, and a second side surface 34 and a third side surface 35 arranged at two ends of the first side surface 33 and perpendicular to the first side surface 33, wherein the second side surface 34 is attached to the vertical plate part 21, and the first side surface 33, the second side surface 34, the third side surface 35, and the flat plate part 22 define a cavity.

In the present embodiment, the defined cavity may be in a cuboid shape. In other embodiments not shown, the wiring box 30 may also be in other specific shapes, such as a round tube shape, which is not limited herein.

In another embodiment, as shown in FIG. 5, the rear end and the front end of the cavity are respectively provided with a first opening 31 and a second opening 32, so that the wire harness 50 threaded from the terminal box cover 40 is threaded into the cavity from the first opening 31, then is threaded out through the second opening 32, and is connected to an electrical component at the front end of the drawer 300. In other words, the front end of the first support member 10 is provided with the terminal box cover 40, so that the wire harness 50 is threaded from the terminal box cover 40, then is threaded into the cavity from the first opening 31 at the rear end of the cavity, and then is threaded out through the second opening 32 at the front end of the cavity; the end of the wire harness 50 is threaded into the drawer 300 and is finally connected to the electrical component at the front end of the drawer 300. Such a threading direction of the wire harness 50 makes its trajectory smooth. In an embodiment, the first opening 31 may be arranged as a rectangle with a certain length, so that the wire harness 50 has a certain activity space at this position, so as to meet the movement space when the wiring harness 50 is drawn out of the storage compartment 200 together with the wiring box 30 connected to the drawer 300.

Figure 6:
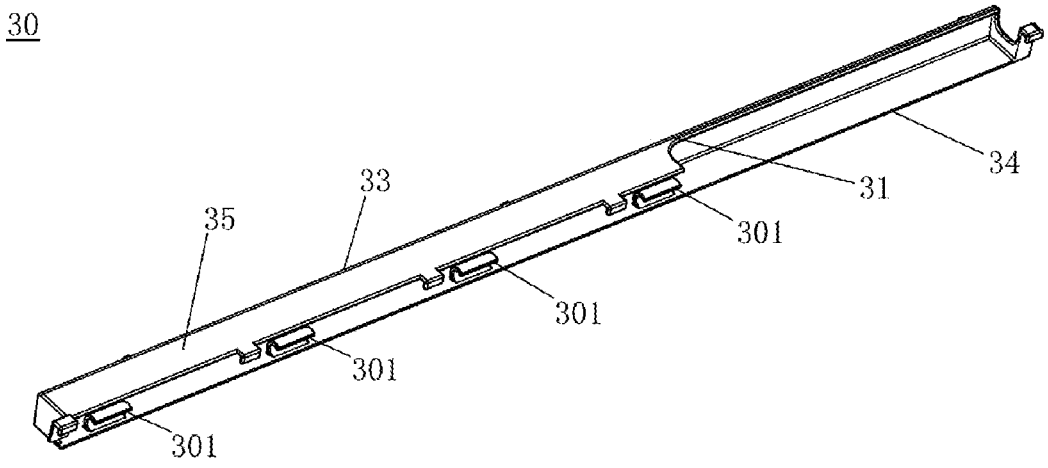
FIG. 6 is a schematic structural diagram of a wiring box of a slide rail assembly in a refrigerator according to an embodiment of the present invention.

FIG. 6 is a schematic structural diagram of a wiring box of a slide rail assembly in a refrigerator according to an embodiment of the present invention. In an embodiment, as shown in FIG. 6, the cavity is internally provided with a plurality of cavity fixing structures 301 which are arranged at intervals along the pulling direction of the drawer 300 and are used for threading and fixing the wire harness 50. Optionally, the cavity fixing structures 301 are tubular, and form a plurality of channels penetrating along the pulling direction of the drawer 300 with the bottom wall of the cavity.

When the drawer 300 in the refrigerator 1000 of the present embodiment is pulled out, since the front end of the wire harness 50 is limited by the claws, the end of the wire harness 50 is pulled out outward with the drawer 300, so that the position of the front end of the wire harness 50 relative to the storage compartment 200 does not change, and the part of the wire harness 50 located outside the wiring box 30 is drawn into the wiring box 30.

When the drawer 300 in the refrigerator 1000 is pulled back, the end of the wire harness 50 is retracted together with the drawer 300. Since the front end of the wire harness 50 is fixed by the claws, when the drawer 300 is pulled back, the distance between the first opening 31 of the wiring box 30 and the front end of the fixed wire harness 50 increases, and a part of the wire harness 50 in the wiring box 30 is drawn out of the wiring box 30.

Hereto, those skilled in the art should realize that although multiple exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and deemed to cover all such other variations or modifications.

The invention claimed is:

1. A refrigerator, comprising:

a storage compartment;

a drawer, arranged in the storage compartment in a drawable manner; and a slide rail assembly, arranged between the drawer and a side wall of the storage compartment and comprising:

a first support member, extending along a pulling direction of the drawer and connected to a side wall of the storage compartment, a front end of the first support member being provided with an installation part, wherein a top of the installation part is fixedly provided with a terminal box cover; a bottom of the installation part is provided with an installation part fixing structure; the installation part fixing structure comprises a plurality of claws configured to fix a wire harness threaded from the terminal box cover; the plurality of claws are arranged at intervals along an arc; and the arc is in a form that a middle part bulges upward and both ends hang downward, wherein each of the claws comprises:

an arched tube, a side of the tube and the installation part forming an inlet of the wire harness; and a baffle plate, erected on the side of the tube provided with the inlet of the wire harness and forming an access passage of the wire harness together with the tube, so that the wire harness enters inside the tube sequentially from the access passage of the wire harness and the inlet of the wire harness so as to fix the wire harness.

2. The refrigerator according to claim 1, wherein there are three claws, respectively arranged at the middle part and both ends of the arc.

3. The refrigerator according to claim 1, wherein the bottom of the installation part is in a box shape and comprises a bottom wall and side walls surrounding the bottom wall; the bottom wall and the side walls define an accommodating cavity with an opening facing the side wall of the storage compartment; and the plurality of claws are located in the accommodating cavity.

4. The refrigerator according to claim 3, wherein the side wall at the bottom of the installation part is provided with a notch for the wire harness threaded from the installation part fixing structure to pass through.

5. The refrigerator according to claim 1, further comprising:

a second support member, extending along the pulling direction of the drawer and connected to the drawer; and a wiring box, extending along the pulling direction of the drawer, and the wiring box together with the second support member defining a cavity which extends along the pulling direction of the drawer, and is used for threading the wire harness threaded from the installation part.

6. The refrigerator according to claim 5, wherein the second support member comprises a vertical plate part vertically arranged and a flat plate part protruding from the vertical plate part toward the first support member; and the wiring box comprises a first side surface arranged in parallel with the flat plate part, and a second side surface and a third side surface arranged at two ends of the first side surface and perpendicular to the first side surface, wherein the second side surface is attached to the vertical plate part, and the first side surface, the second side surface, the third side surface, and the flat plate part define the cavity.

7. The refrigerator according to claim 6, wherein a rear end and a front end of the cavity are respectively provided with a first opening and a second opening, so that the wire harness threaded from the terminal box cover is threaded into the cavity via the first opening, then is threaded out through the second opening, and is connected to an electrical component at a front end of the drawer.

8. The refrigerator according to claim 7, wherein the cavity is internally provided with a plurality of cavity fixing structures arranged at intervals along the pulling direction of the drawer and used for threading and fixing the wire harness.

9. The refrigerator according to claim 1, wherein the drawer is a drawable temperature-variable drawer.

* * * * *